US010386111B2

(12) United States Patent
Akca et al.

(10) Patent No.: US 10,386,111 B2
(45) Date of Patent: Aug. 20, 2019

(54) HOME APPLIANCE DEVICE AND METHOD FOR ASSEMBLING A HOME APPLIANCE DEVICE

(71) Applicant: BSH-HAUSGERAETE GMBH, Munich (DE)

(72) Inventors: Serdar Akca, Tekirdag (TR); Mehmet Ciyanoglu, Istanbul (TR); Lars Dinter, Munich (DE); Emre Guentav, Istanbul (TR); Tanzer Yildizgoecer, Tekirdag (TR); Rasit Oenver, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/364,495

(22) Filed: Nov. 30, 2016

(65) Prior Publication Data

US 2018/0149408 A1 May 31, 2018

(51) Int. Cl.

| | |
|---|---|
| ***F25D 23/02*** | (2006.01) |
| ***E05B 17/00*** | (2006.01) |
| ***E05F 1/00*** | (2006.01) |
| ***F25D 11/00*** | (2006.01) |
| ***F25D 23/12*** | (2006.01) |
| ***E05F 3/22*** | (2006.01) |
| ***E05F 15/63*** | (2015.01) |

(52) U.S. Cl.

CPC ..... *F25D 23/028* (2013.01); *E05B 17/0033* (2013.01); *E05F 1/00* (2013.01); *E05F 3/224* (2013.01); *E05F 15/63* (2015.01); *F25D 11/00* (2013.01); *F25D 23/126* (2013.01); *E05Y 2201/426* (2013.01); *E05Y 2900/30* (2013.01); *E05Y 2900/31* (2013.01); *F25D 2323/00264* (2013.01); *F25D 2323/00274* (2013.01)

(58) Field of Classification Search

CPC ..... F25D 23/028; F25D 23/126; F25D 11/00; E05B 17/0033; E05F 1/00

See application file for complete search history.

(56) References Cited

U.S. PATENT DOCUMENTS 3,012,837 A * 12/1961 Morrissey, Jr. ..... E05B 17/0033 49/276
3,030,102 A * 4/1962 Smith ..... E05B 53/001 292/198
4,707,684 A * 11/1987 Janke ..... F25D 29/008 200/61.62

(Continued)

FOREIGN PATENT DOCUMENTS

DE 202007010237 U1 9/2007
DE 102007021553 A1 * 11/2008 ..... A47B 77/08

(Continued)

*Primary Examiner* — Hanh V Tran

(74) *Attorney, Agent, or Firm* — Laurence A. Greenberg; Werner H. Stemer; Ralph E. Locher

(57) ABSTRACT

For the purpose of improving properties regarding construction a home appliance device, in particular a home chiller appliance device, is proposed. The device has at least one main body defining at least one storage space; at least one door mounted to the main body and featuring at least one sealed door section that forms at least a portion of a front wall of the storage space; and at least one protrusion unit arranged next to the sealed door section outside the storage space and protruding from the door towards the main body.

16 Claims, 12 Drawing Sheets

(56) References Cited

U.S. PATENT DOCUMENTS 4,911,508 A * 3/1990 Tillman ..... E05B 17/0033 292/255
5,522,656 A * 6/1996 Jenkins ..... E05F 1/1246 126/194
5,975,662 A * 11/1999 Weber ..... A47B 88/463 292/251.5
6,328,392 B1 * 12/2001 Whitcomb ..... E05B 17/0033 312/319.1
6,338,536 B1 * 1/2002 Ueno ..... E05B 17/0033 312/405
6,533,375 B2 * 3/2003 Fulterer ..... H03K 17/968 250/221
6,711,856 B1 * 3/2004 Hoffman ..... E05F 1/105 296/207
8,894,168 B2 * 11/2014 Lee ..... F25D 23/028 312/405
9,726,421 B2 * 8/2017 Kempfle ..... F25D 23/028
2004/0103584 A1 * 6/2004 Freeman ..... G10L 15/26 49/334
2005/0045457 A1 * 3/2005 Park ..... F25D 29/005 200/61.7
2006/0107597 A1 * 5/2006 Jin ..... E05F 15/63 49/149
2008/0231158 A1 * 9/2008 Keller ..... F25D 17/047 312/405
2010/0307189 A1 * 12/2010 Keller ..... F25D 17/047 62/449
2011/0016907 A1 * 1/2011 Kang ..... F25D 23/028 62/449
2011/0036383 A1 * 2/2011 Tiekoetter ..... A47L 15/4259 134/57 DL
2013/0276474 A1 * 10/2013 Kim ..... F25D 11/00 62/449
2014/0210328 A1 * 7/2014 Akalan ..... F25D 23/028 312/326
2015/0338156 A1 * 11/2015 Held ..... F25D 23/028 312/405
2015/0338158 A1 * 11/2015 Maas ..... F25D 23/04 312/405
2016/0116206 A1 * 4/2016 Kempfle ..... F25D 23/028 312/405
2016/0161175 A1 * 6/2016 Benold ..... F25D 23/10 312/405
2016/0281408 A1 * 9/2016 Kempfle ..... F25D 23/028
2016/0312516 A1 * 10/2016 Heydel ..... H02K 7/116
2017/0205134 A1 * 7/2017 Osbar ..... F25D 23/028
2017/0321953 A1 * 11/2017 Kempfle ..... F25D 23/028

FOREIGN PATENT DOCUMENTS

DE 102009000848 A1 * 8/2010 ..... F25D 27/00
JP 2006138582 A 6/2006
WO 2009013121 A2 1/2009
WO 2014194953 A1 12/2014
WO 2016174148 A2 11/2016
WO 2016174149 A1 11/2016

* cited by examiner

HOME APPLIANCE DEVICE AND METHOD FOR ASSEMBLING A HOME APPLIANCE DEVICE

BACKGROUND OF THE INVENTION

Field of the Invention

The invention relates to a home appliance device, in particular a home chiller appliance device, and to a method for assembling a home appliance device, in particular a home chiller appliance device.

From the prior art, refrigerators comprising a main body and a door are known. The door features a sealed section which delimits a storage space within an inner liner towards a front side. The door is flat except for the sealed section outside the storage space.

SUMMARY OF THE INVENTION

An objective of the invention is, in particular, to provide a home appliance device with improved characteristics regarding construction. This objective is achieved, according to the claimed invention. Further implementations and further developments of the invention may be gathered from the dependent claims.

A home appliance device, in particular a home chiller appliance device, is proposed, comprising: at least one main body defining at least one storage space; at least one door mounted to the main body and featuring at least one sealed door section that forms at least a portion of a front wall of the storage space; and at least one protrusion unit which is arranged next to the sealed door section, in particular on an inside of the door, outside the storage space and protrudes in particular significantly from the door towards the main body.

By means of the invention, in particular an advantageous construction of a home appliance device can be achieved. High user-friendliness can be provided. Furthermore, high efficiency and/or low energy demand can be achieved. A durable and/or reliable construction for a door opening assistant can be provided. In particular, component load during transmission of opening forces can be reduced. Furthermore, undesired heat transfer can be minimized. In addition, comfort functions like a supply of ice water and/or ice cubes can be efficiently implemented in a home appliance. In particular, different functionalities can be implemented in a door of a home appliance, in particular in a space-efficient manner. Furthermore, easy and/or cheap assembly is facilitated.

By a "home appliance device" is in particular to be understood at least a portion, in particular a sub-assembly group, of a home appliance. The home appliance is in particular provided for storing and in particular tempering victuals such as beverages, meat, fish, vegetables, fruits, milk and/or dairy products in at least one operating state, in particular for the purpose of enhancing a keepability of the stored victuals. In particular, the home appliance is embodied as a home chiller appliance which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g. an oven, a steamer and/or a microwave. In this context, "configured" is in particular to mean specifically programmed, designed and/or equipped. By an object being configured for a certain function is in particular to be understood that the object implements and/or fulfills said certain function in at least one application state and/or operating state.

In particular, the home appliance device may comprise at least one inner liner. In particular, the home appliance device may comprise at least one outer liner. In particular, the inner liner may be arranged inside the outer liner. In particular, there may be a gap between the inner liner and the outer liner, which may in particular be filled with foam, for instance with polyurethane foam. During assembly, the inner liner may in particular be placed inside the outer liner and the gap may be subsequently filled with foam during foaming. In particular, the inner liner and the outer liner may together form at least a portion of the main body or the main body of the home appliance device.

In particular, the storage space may be arranged within the inner liner. The storage space may in particular be delimited by the main body and by the sealed door section. In particular, the door may be pivoted about a vertical pivot axis. In this context, "vertical" is in particular to be understood as referring to a direction that is perpendicular to a ground on which the home appliance and/or the home appliance device stands in at least one normal operating condition. In particular, the home appliance device may have at least one height direction. The height direction is in particular oriented vertically. Furthermore, the main body may have in particular at least one top side and/or at least one bottom side. In particular, the height direction may point from the bottom side of the main body to the top side of the main body.

In particular, the sealed door section may have a rectangular shape. In particular, the sealed door section may form the front wall of the storage space. In particular, the sealed door section may feature at least one sealing lip, which in particular, may implement an outer border of the sealed door section. In particular, in a closed state the sealing lip may be in contact with the main body. In particular, the door may be the only door for the storage space. However, it is conceivable that the home appliance device may comprise at least one additional storage space, which may be accessible through the door and/or through an additional door. For instance, the storage space may be implemented as a refrigerator storage space and/or the additional storage space may be implemented as a freezer storage space or vice versa. It is further conceivable that the home appliance device may feature at least one second door for the storage space. For instance, the door and the second door may be implemented in a french-door assembly.

In particular, the protrusion unit may be arranged below the sealed door section. In particular, the protrusion unit may be arranged closer to the bottom side of the main body than the sealed door section, particularly in a direction parallel to the height direction.

In particular, the protrusion unit may be at least partly, in particular solely or completely connected to the door. However, it is also conceivable that the protrusion unit may be at least partly or solely connected to the main body. In particular, the protrusion unit may be in parts connected to the door and in parts connected to the main body. In particular, the door may comprise at least one non-sealed door section arranged next to the sealed door section outside the storage space, in particular arranged below the sealed door section. In particular, the protrusion unit may be connected to the non-sealed door section. In particular, the protrusion unit may be arranged adjacent to the non-sealed door section. In particular, the non-sealed door section may be at least substantially planar or planar. In particular, the protrusion unit may protrude, in particular significantly, from the non-sealed door section towards the main body, for example by at least 1 cm or by at least 2 cm or by at least 5 cm or by at least 7 cm.

Further, it is proposed that the protrusion unit may feature a smaller horizontal extent than a horizontal extent of the sealed door section. In particular, "horizontal" is to be understood with reference to "vertical". The horizontal extent may in particular an extent that is perpendicular to the height direction and/or parallel to a main extension plane of the door and/or of the non-sealed door section and/or of the sealed door section. In particular, the horizontal extent of the protrusion unit may be no greater than 50% or no greater than 20% or no greater than 10% of the horizontal extent of the sealed door section. In particular, the horizontal extent of the sealed door section may at least be substantially the same or may be the same as a horizontal extent of the door. In particular, a main extension direction of the protrusion unit may be oriented parallel to the height direction. In particular, the protrusion unit may be arranged centrally with respect to the horizontal extent of the sealed door section. A "main extension plane" of an object is, in particular, to be understood as a plane extending parallel to a largest side of an imaginary rectangular cuboid which only just entirely encloses the object and preferably extends through a geometric center of the object. A "main extension direction" of an object is, in particular, to be understood, in this context, as a direction extending in parallel to a largest side of an imaginary rectangular cuboid which only just entirely encloses the object. In this context, the term "at least substantially" is to mean that a deviation of a first value from a second value is in particular smaller than 25%, preferably smaller than 10% and advantageously smaller than 5% of the second value. As a result, advantageous properties regarding an arrangement of components can be achieved.

High comfort and/or high durability can be achieved if the home appliance device may comprise a door opening assisting unit featuring at least one opening element, and if the protrusion unit may feature at least one contact element for the opening element. In particular, the door opening assisting unit may be arranged within the main body. In particular, the door opening assisting unit may be arranged outside the storage space. In particular, the opening element may be rod-shaped. In particular, the opening element may be implemented as a push rod. In particular, the opening element may be configured for being pushed against the contact element in at least one door opening condition. In particular, the door opening assisting unit may be configured for partly opening the door and/or for supporting a user in opening the door. In particular, the door opening assisting unit may be configured for detecting at least one door opening request of a user. In particular, the contact element may be implemented separately from the door. In particular, the contact element may be connected to the door. In particular, the contact element may define a top end of the protrusion unit. In particular, the contact element may be at least partly or at least to a large extent or completely be made of metal. It is also conceivable that the contact element may be at least partly or at least to a large extent or completely be made of plastic. The term "at least to a large extent" is in particular to mean to an extent of at least 55%, preferably to an extent of at least 65%, further preferably to an extent of at least 75%, advantageously to an extent of at least 85% and further advantageously to an extent of at least 95%. In particular, the contact element may be made of one piece. "Made of one piece" is, in particular, to mean, in this context, manufactured from one single piece, e.g., by production from one single cast and/or by manufacturing in a one-component or multi-component injection-molding process, and in particular from a single blank.

For the purpose of efficient and/or targeted force transmission, it is proposed that the contact element may feature at least one contact surface for the opening element, which contact surface may be aligned at least substantially parallel or parallel to a main extension plane of the door and/or of the non-sealed door section and/or of the sealed door section. In particular, the contact surface may be configured for receiving a pushing force exerted onto it by the opening element. The contact surface may in particular be larger than a forward surface, e.g. a forward facing surface, of the opening element, which is in contact with the contact surface in the door opening condition. In particular, the contact surface is rectangular, in particular squared. In particular, the contact element may be box-shaped. In particular, the contact element may feature at least one contact element side wall which may be connected to a contact element front wall, which contact element front wall may feature the contact surface. In particular, the contact element may feature three contact element side walls, which are connected to the contact element front wall, namely in particular a top side wall and two lateral side walls. It is also conceivable that the contact element may feature four or more contact element side walls, in particular including at least one bottom side wall. In particular, the contact element front wall may be rectangular, in particular squared. In particular, the contact element may feature at least one rectangular, in particular squared cross section. In this context, "at least substantially parallel" is in particular to mean an orientation of a direction with respect to a reference direction, in particular in a plane, wherein the direction has a deviation from the reference direction in particular of less than 15°, advantageously of less than 10° and particularly advantageously of less than 2°.

High-level strength and/or easy manufacturability can be achieved if the contact element may be implemented as a bent sheet metal piece. In particular, the contact element may be implemented as a stamped and-bent-piece.

Advantageous properties regarding force transmission can be achieved if the contact element may feature at least one contact element side wall with a step-shaped contour. In particular, the contact element side wall may be connected to the contact element front wall. In particular, the step-shaped contour may be arranged on a top side of the contact element side wall. In particular, the contact element may comprise at least one contact element side wall which may be step-shaped and which may in particular feature at least one front side surface which may be oriented parallel to the contact surface and/or arranged offset from the contact surface towards the door. In particular, the contact element may feature a rear-side cross section which may be significantly larger than the contact surface and which may in particular be arranged on a rear side of the contact element facing the door.

For the purpose of avoiding wear owing to operation of a door opening assistant, it is proposed that the protrusion unit may comprise a fixing unit featuring at least one fixing element, that the contact element may be connected to the fixing element, and that the fixing element may be arranged inside a foamed gap space of the door. In particular, the fixing element may be arranged inside the door. In particular, the contact element may be connected to the fixing element in the height direction. In particular, the contact element may be connected to the fixing element from below the sealed door section. In addition, the fixing unit may comprise at least one support element which the fixing element is connected to. In particular, the support element is plate-shaped. In particular, the support element may be arranged inside the door, for example within the foamed gap space of the door, and/or outside the foamed gap space of the door, in particular on a side of the foamed gap space that faces away from the storage space.

Furthermore, it is proposed that the protrusion unit may feature at least one air separator, which separates two adjacent air spaces, in particular at least one first air space and at least one second air space, which may be located outside the storage space and arranged between the door and the main body. In particular, the contact element and the air separator together implement the protrusion unit.

In particular, the home appliance device may comprise at least one machine compartment arranged next to the non-sealed door section and/or next to the storage space, in particular below the storage space and/or within the main body. In particular, the machine compartment may comprise at least one first sub-compartment arranged behind the first air space and at least one second sub-compartment arranged behind the second air space. In particular, the first sub-compartment and the second sub-compartment may be separated from each other, in particular by at least one divisional wall. In particular, the first sub-compartment may be open towards and/or connected to the first air space and/or the second sub-compartment may be open towards and/or connected to the second air space, particularly through at least one ventilation grille. In particular, the first sub-compartment may comprise at least one fresh-air entrance, which may in particular be connected to the first air space, and/or the second sub-compartment comprises at least one heated-air exit, which may in particular be connected to the second air space. In particular, the first air space and/or the second air space may be delimited by the sealed door section, in particular on a top side. In particular, the first air space and/or the second air space may be open towards an outside, in particular away from the sealed door section, in particular towards the bottom side of the main body and/or towards the ground. In particular, the air separator may, in particular solely, be connected to the door, in particular to the non-sealed door section. In particular, the air separator may be in contact with the door and with the main body, at least in a closed state of the door. In particular, the air separator may be plate-shaped. In particular, a main extension plane of the air separator may be oriented perpendicularly to the main extension plane of the door and/or parallel to the height direction. In particular, a main extension direction of the air separator may be oriented parallel to the height direction. In particular, the air separator may be arranged next to the contact element, in particular below the contact element. In particular, the air separator may be in contact with the contact element. The air separator may in particular be at least partly, in particular at least to a large extent, in particular completely be made of plastic. However, it is also conceivable that the air separator is at least partly, at least to a large extent or completely made of metal. As a result, undesirable heat exchange can be prevented and/or a high grade of efficiency can be achieved.

For the purpose of effective thermal screening it is proposed that the air separator may feature at least one sealing element that may contact the main body, at least in a closed state of the door. In particular, the sealing element may extend from the contact element towards a bottom end of the non-sealed door section. The sealing element may in particular be implemented as an, in particular straight, sealing lip. It is further conceivable that the air separator may feature an additional sealing element that contacts the door, in particular the non-sealed door section. In particular, the sealing element and/or the additional sealing element may at least partly, in particular at least to a large extent and further in particular completely be made of plastic, in particular of an elastomer. In particular, the sealing element may at least partly be macroscopically deformable, or macroscopically deformable. In particular, the air separator may comprise at least one support element. The sealing element and/or the additional sealing element may be in particular connected to the support element. In particular, the support element or at least a portion of the support element, in particular a portion of the support element extending over at least 50%, preferably over at least 75% of a length of the support element, may be plate-shaped. In this context, a "macroscopically deformable object" is, in particular, an object having at least one extension in at least one direction, which extension can be, in particular temporarily and/or without damage, altered by at least 1%, preferably by at least 5%, further preferably by at least 20% and advantageously by at least 50% when a force is applied to the object that is no greater than 100 kN $mm^{-2}$, preferably no greater than 10 kN $mm^{-2}$ and advantageously no greater than 1 kN $mm^{-2}$.

Easy manufacturability can be achieved and/or a diversity of parts can be reduced if the air separator may be connected to the contact element. In particular, the air separator may be fixed to the contact element.

Fast and/or easy alignment during assembly and/or high air-tightness can be achieved if the air separator may partly be inserted in the contact element, in particular from a bottom side of the contact element. The contact element in particular covers a top portion of the air separator. In particular, the air separator may be connected to the contact element by at least one fastening element, in particular by at least two fastening elements, for instance by screws and/or bolts and/or pins and/or nails and/or rivets, in particular from two opposite sides.

For the purpose of providing reliable locking and/or failsafe manufacturability, it is proposed that the contact element may feature at least two mounting holes for the air separator which have different hole axes. In particular, the hole axes may be oriented at least substantially parallel, or parallel, to each other and/or at least substantially parallel, or parallel, to the horizontal direction. The air separator may in particular be fixed to the contact element by at least one fixing element per mounting hole. In particular, the mounting holes may be offset from each other along the height direction. As a result, turning of elements during screwing can be avoided.

It is further proposed that the home appliance device may comprise at least one liquid line, in particular at least one water line, which runs through the protrusion unit, in particular through the contact element and/or through the air separator, in particular in a direction parallel to the height direction. In particular, the liquid line may be part of an ice supply unit and/or an ice water supply unit and/or an ice water dispenser unit, which may be in particular part of the home appliance device and which may in particular be arranged on the door. In particular, the liquid line may be a water supply line. As a result, high comfort can be provided while a structural complexity can be reduced.

Advantageous properties regarding construction can be achieved with a home appliance comprising at least one home appliance device according to the invention.

Furthermore, a method for assembling a home appliance device, in particular a home chiller appliance device, is proposed, wherein the home appliance device comprises: at least one main body defining at least one storage space; at least one door mounted to the main body, featuring at least one sealed door section forming at least a part of a front wall of the storage space; at least one door opening assisting unit having at least one opening element; and at least one protrusion unit arranged next to the sealed door section outside the storage space, which protrudes from the door towards the main body and which features at least one contact element for the opening element and at least one air separator separating two adjacent air spaces which are located outside the storage space and arranged between the door and the main body; and wherein the air separator is attached to the contact element.

By means of the invention, in particular an advantageous construction of a home appliance device can be achieved. High user-friendliness can be provided. Furthermore, high efficiency and/or low energy demand can be achieved. A durable and/or reliable construction for a door opening assistant can be provided. In particular, component load during transmission of opening forces can be reduced. Furthermore, undesired heat transfer can be minimized. In addition, comfort functions like a supply of ice water and/or ice cubes can be efficiently implemented in a home appliance. In particular, different functionalities can be implemented in a door of a home appliance, in particular in a space-efficient manner. Furthermore, easy and/or cheap assembly is facilitated.

Herein the home appliance device and the method according to the invention are not to be limited to the application and implementation described above. In particular, for the purpose of fulfilling a functionality herein described, the home appliance device and the method according to the invention may comprise a number of respective elements, structural components, units and/or steps that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing exemplary embodiments of the invention are shown. The drawing, the description and the claims contain a plurality of features in combination. The person having ordinary skill in the art will purposefully also consider the features separately and will find further expedient combinations.

If there is more than one specimen of a certain object, in some instance only one of these may be given a reference numeral in the figures and in the description. The description of this specimen may be correspondingly transferred to the other specimens of the object.

DETAILED DESCRIPTION OF THE INVENTION

Figure 1:
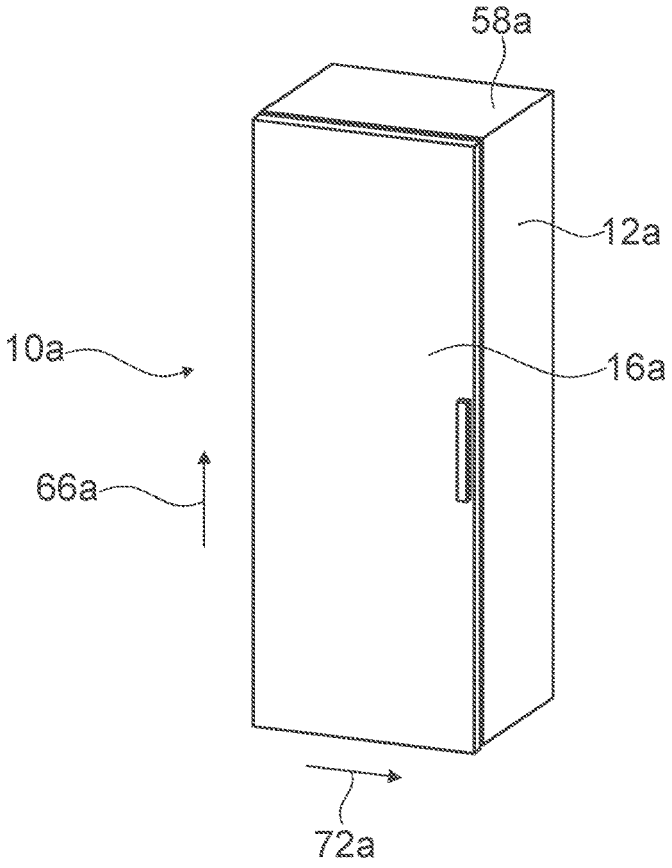
FIG. 1 a home appliance comprising a home appliance device, in a perspective view, FIG. 2 a portion of the home appliance device, including a door and a protrusion unit of the home appliance device, in a perspective view, FIG. 3 a portion of the home appliance device, including a door opening assisting unit of the home appliance device, in a schematic sectional lateral view, FIG. 4 a portion of the home appliance device, including a machine compartment of the home appliance device, in a schematic sectional top view, FIG. 5 a portion of the door of the home appliance device, including the protrusion unit, in a perspective view, FIG. 6 a contact element of the protrusion unit, in a perspective view, FIG. 7 the contact element, in a schematic lateral view, FIG. 8 the contact element, in an additional schematic lateral view, FIG. 9 the protrusion unit, in a schematic exploded view, FIG. 10 a schematic flow chart of a method for assembling a home appliance device, FIG. 11 an alternative home appliance comprising an alternative home appliance device, in a perspective view, FIG. 12 a protrusion unit of the alternative home appliance device, comprising a contact element and an air separator, in a schematic exploded view, FIG. 13 a support element of the air separator, in a schematic front view, FIG. 14 the support element, in a schematic lateral view, FIG. 15 the contact element and a fixing unit of the alternative home appliance device, in a perspective view, FIG. 16 a further alternative home appliance device in a perspective view, FIG. 17 a contact element of a protrusion unit of the further alternative home appliance device, in a perspective view, FIG. 18 the contact element, in a further perspective view, and FIG. 19 a portion of the further alternative home appliance device, including the contact element and a liquid line, in a perspective view.

FIG. 1 shows a home appliance 58*a* in a perspective view. The home appliance 58*a* comprises a home appliance device 10*a*. The home appliance 58*a* is implemented as a home chiller appliance. In the case shown the home appliance 58*a* is implemented as a refrigerator. The home appliance device 10*a* is implemented as a home chiller appliance device.

The home appliance device 10*a* comprises a main body 12*a*. Furthermore, the home appliance device 10*a* comprises a door 16*a* mounted to the main body 12*a*. The main body 12*a* has a height direction 66*a*. The height direction 66*a* is a vertical direction.

Figure 2:
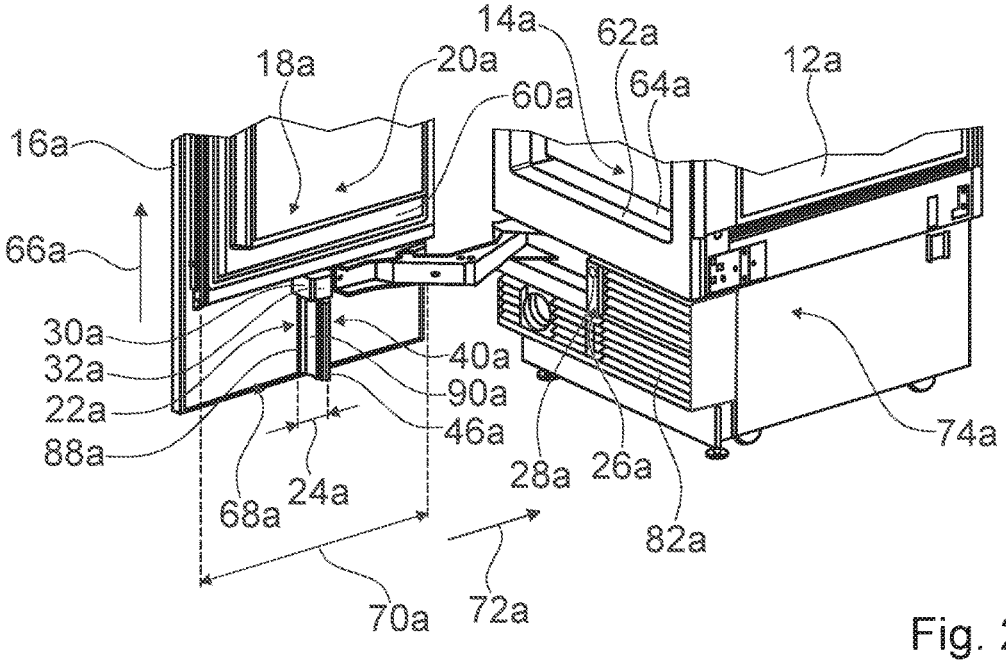

FIG. 2 shows a portion of the home appliance device 10*a*, including the door 16*a* and the main body 12*a*, in a perspective view. The main body 12*a* defines a storage space 14*a*. The main body 12*a* comprises an outer liner 62*a* and an inner liner 64*a*, which is arranged within the outer liner 62*a*.

The door 16*a* features a sealed door section 18*a* that forms at least a portion of a front wall 20*a* of the storage space 14*a*. The sealed door section 18*a* comprises a sealing lip 60*a*, which seals the storage space 14*a* in a closed state.

The home appliance device 10*a* comprises a protrusion unit 22*a* arranged next to the sealed door section 18*a* outside the storage space 14*a*. The protrusion unit 22*a* protrudes from the door 16*a* towards the main body 12*a*. The door 16*a* features a non-sealed door section 68*a* arranged next to the sealed door section 18*a*. The non-sealed door section 68*a* is arranged below the sealed door section 18*a* with respect to the height direction 66*a*. The protrusion unit 22*a* is connected to the door 16*a*. The protrusion unit 22*a* is connected to the non-sealed door section 68*a*. It is conceivable that a non-sealed door section and/or a protrusion unit is arranged above a sealed door section. Furthermore, it is conceivable that a protrusion unit is connected to a main body.

The protrusion unit 22*a* features a smaller horizontal extent 24*a* than the sealed door section 18*a*, in particular parallel to a horizontal direction 72*a* of the door 16*a*. The horizontal direction 72*a* of the door 16*a* is oriented perpendicularly to the height direction 66*a* and parallel to a main extension plane of the door 16*a*.

The horizontal extent 24*a* of the protrusion unit 22*a* is smaller than 20% of a horizontal extent 70*a* of the sealed door section 18*a*. The horizontal extent 24*a* of the protrusion unit 22*a* is significantly smaller than the horizontal extent 70*a* of the sealed door section 18*a*.

The home appliance device 10*a* comprises a door opening assisting unit 26*a* which has an opening element 28*a*. The opening element 28*a* is implemented as a push rod. The opening unit 26*a* is configured for partly opening the door 16*a* upon a user request for a door opening.

Figure 4:
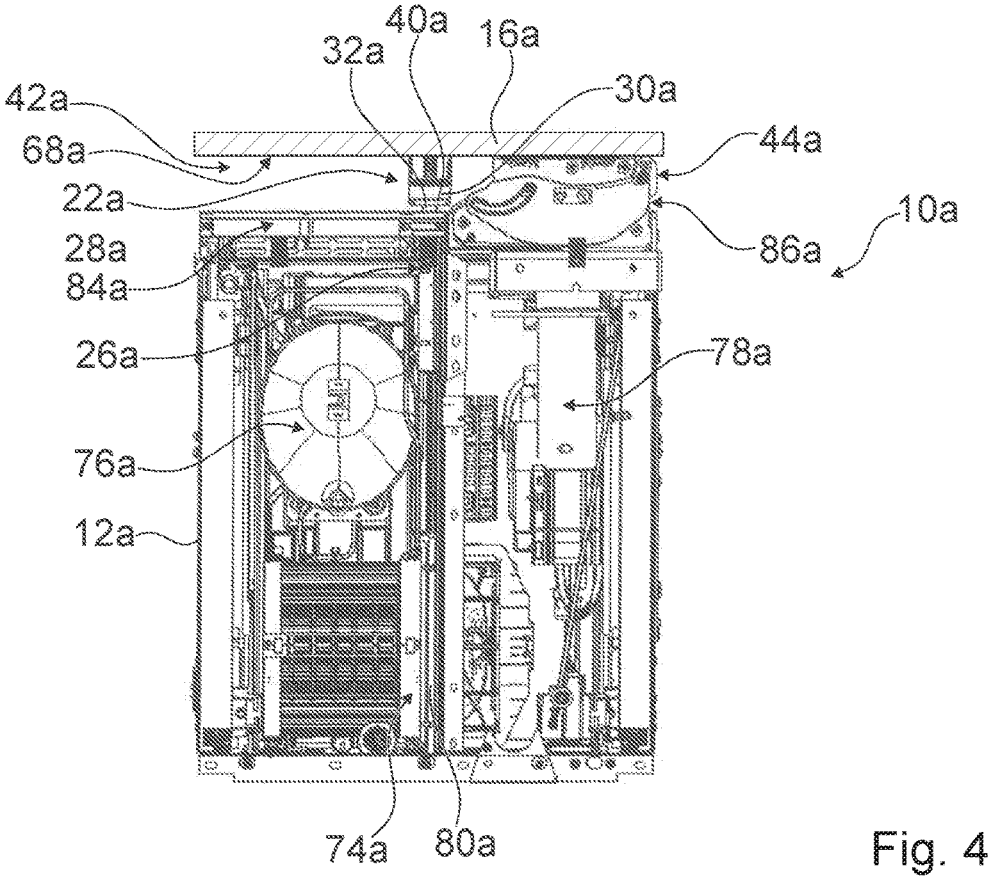

FIG. 4 shows a portion of the home appliance device 10*a*, including the door opening assisting unit 26*a*, in a schematic lateral sectional view. Upon a user request of a door opening, the opening element 28*a* is moved towards the door 16*a* in order to partly push the door 16*a* open.

The protrusion unit 22*a* features a contact element 30*a* for the opening element 28*a*. The contact element 30*a* is connected to the door 16*a*. The contact element 30*a* is provided for transmitting an opening force onto the door 16*a*. The opening element 28*a* is provided for being pushed against the contact element 30*a*. The contact element 30*a* is arranged opposite the opening element 28*a*.

The contact element 30*a* features a contact surface 32*a* for the opening element 28*a*, which contact surface 32*a* is aligned parallel to the main extension plane of the door 16*a*. The contact element 30*a* protrudes from the door 16*a* towards the main body 12*a*. The opening element 28*a* therefore has to be moved only over a short distance for opening the door 16*a*.

FIG. 4 shows a portion of the home appliance device 10*a* in a schematic sectional top view. The protrusion unit 22*a* comprises an air separator 40*a* which separates two adjacent air spaces 42*a*, 44*a*, namely a first air space 42*a* and a second air space 44*a*, which are located outside the storage space 14*a* and are arranged between the door 16*a* and the main body 12*a*.

Figure 3:
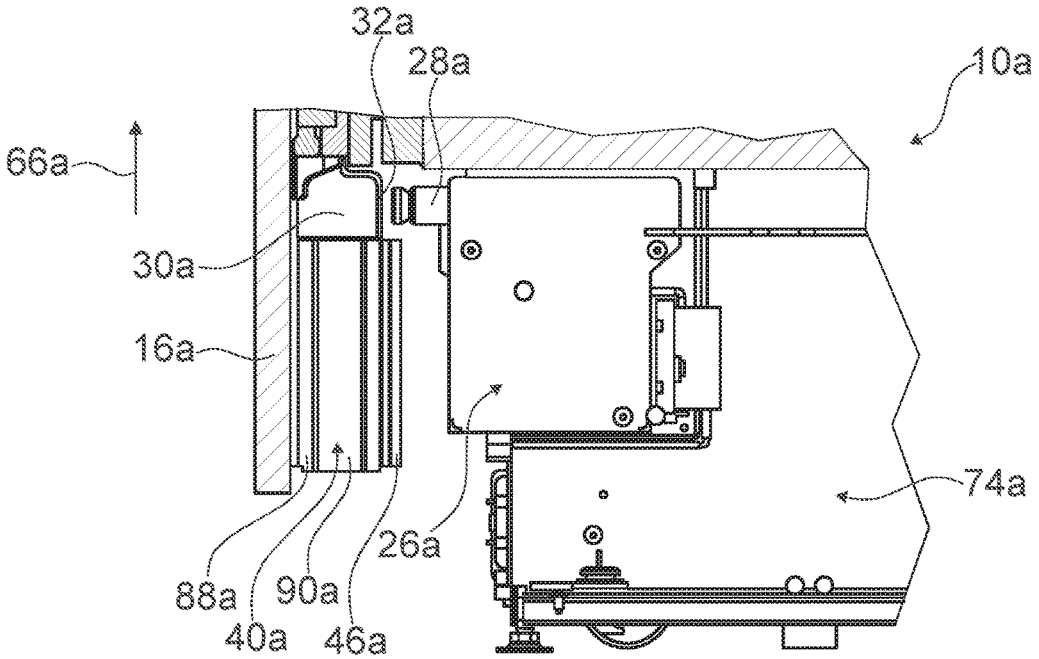

The home appliance device 10*a* comprises a machine compartment 74*a*. The machine compartment 74*a* is arranged below the storage space 14*a* with respect to the height direction 66*a*. The machine compartment 74*a* features a first sub-compartment 76*a* and a second sub-compartment 78*a*. The first sub-compartment 76*a* is arranged behind the first air space 42*a*. The second sub-compartment 78*a* is arranged behind the second air space 44*a*. The first sub-compartment 76*a* and the second sub-compartment 78*a* are separated from each other by a divisional wall 80*a*. The first sub-compartment 76*a* is connected to the first air space 42*a* and the second sub-compartment 78*a* is connected to the second air space 44*a* via at least one ventilation grille 82*a*. The ventilation grille 82*a* is not shown in FIG. 3 for reasons of clarity. The first sub-compartment 76*a* comprises a fresh-air entrance 84*a*, which is connected to the first air space 42*a*. The second sub-compartment 78*a* comprises a heated-air exit 86*a*, which is connected to the second air space 44*a*. The first air space 42*a* and the second air space 44*a* are delimited by the sealed door section 18*a* on a top side. The first air space 42*a* and the second air space 44*a* are open towards an outside, in particular towards a bottom side of the main body 12*a*.

Figure 5:
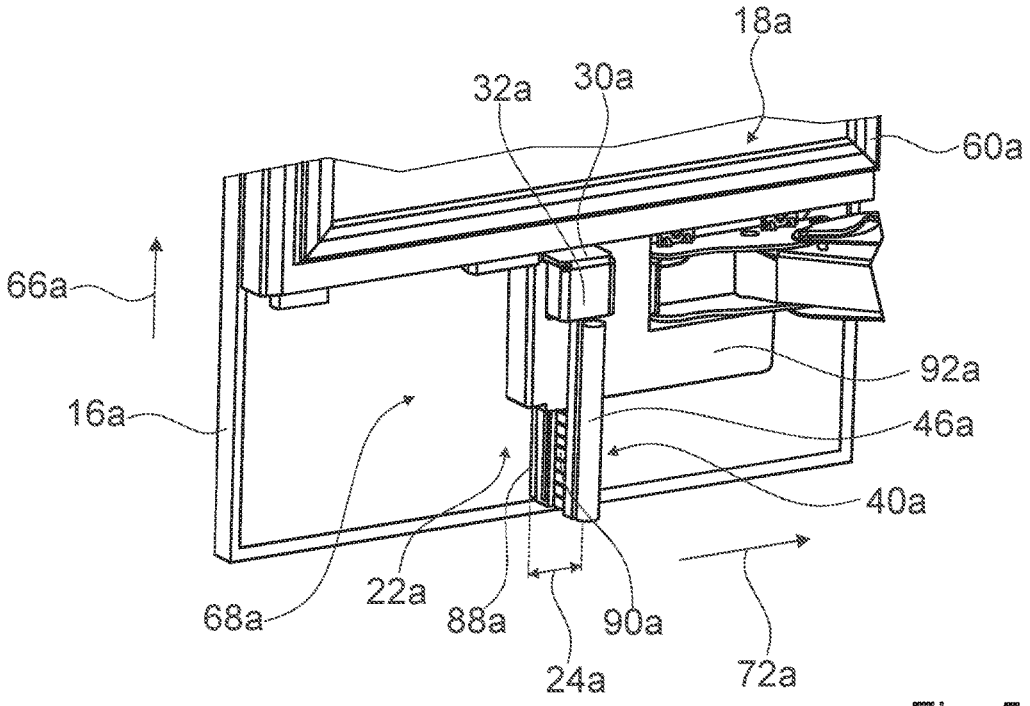

FIG. 5 shows a portion of the door 16*a* of the home appliance device 10*a*, including the protrusion unit 22*a*, in a perspective view. The air separator 40*a* is connected to the door 16*a*. The air separator 40*a* is connected to the non-sealed door section 68*a*. In a closed state of the door 16*a*, the air separator 40*a* is in contact with the door 16*a* and with the main body 12*a*. The air separator 40*a* is plate-shaped. A main extension plane of the air separator 40*a* is oriented perpendicularly to the main extension plane of the door 16*a* and parallel to the height direction 66*a*. A main extension direction of the air separator 40*a* is oriented parallel to the height direction 66*a*. The air separator 40*a* is arranged next to the contact element 30*a*, in particular below the contact element 30*a*. The air separator 40*a* is in contact with the contact element 30*a*. In the shown case the air separator 40*a* is made of plastic.

The air separator 40*a* features a sealing element 46*a* that contacts the main body 12*a*, in particular in the closed state of the door 16*a*. The sealing element 46*a* is implemented as a sealing lip. A main extension direction of the sealing element 46*a* is oriented parallel to the height direction 66*a*. The air separator 40*a* features an additional sealing element 88*a* that contacts the door 16*a*, in particular the non-sealed door section 68*a*. Furthermore, the air separator 40*a* features a support element 90*a*. The sealing element 46*a* is connected to the support element 90*a*. The additional sealing element 88*a* is connected to the support element 90*a*. The additional sealing element 88*a* is significantly shorter than the sealing element 46*a*. The additional sealing element 88*a* features a length which is smaller than 50% of a length of the sealing element 46*a*. The sealing element 46*a* is made of rubber. The additional sealing element 88*a* is made of rubber.

The air separator 40*a* is connected to the contact element 30*a*. The air separator 40*a* is partly inserted in the contact element 30*a*. The contact element 30*a* covers the air separator 40*a* on a top end. The support element 90*a* is partly inserted in the contact element 30*a*. The contact element 30*a* is open towards a bottom side of the main body 12*a*. The protrusion unit 22*a* features a cover element 92*a* that covers a portion of the non-sealed door section 68*a*. The additional sealing element 88*a* contacts the cover element 92*a*.

Figure 6:
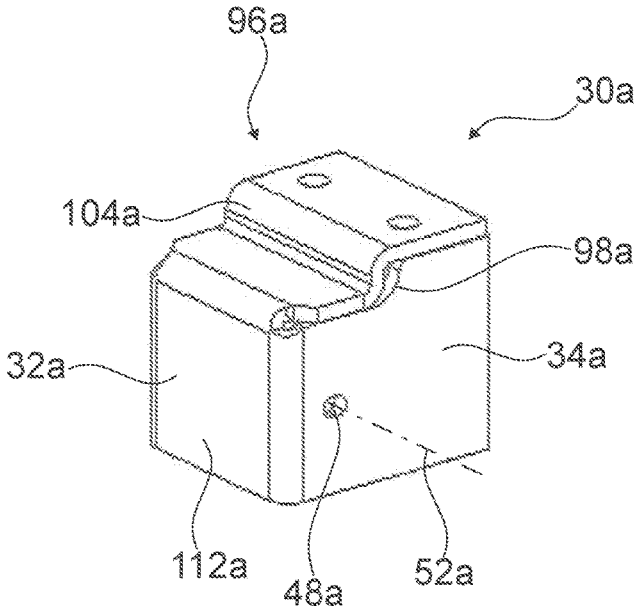
Figure 7:
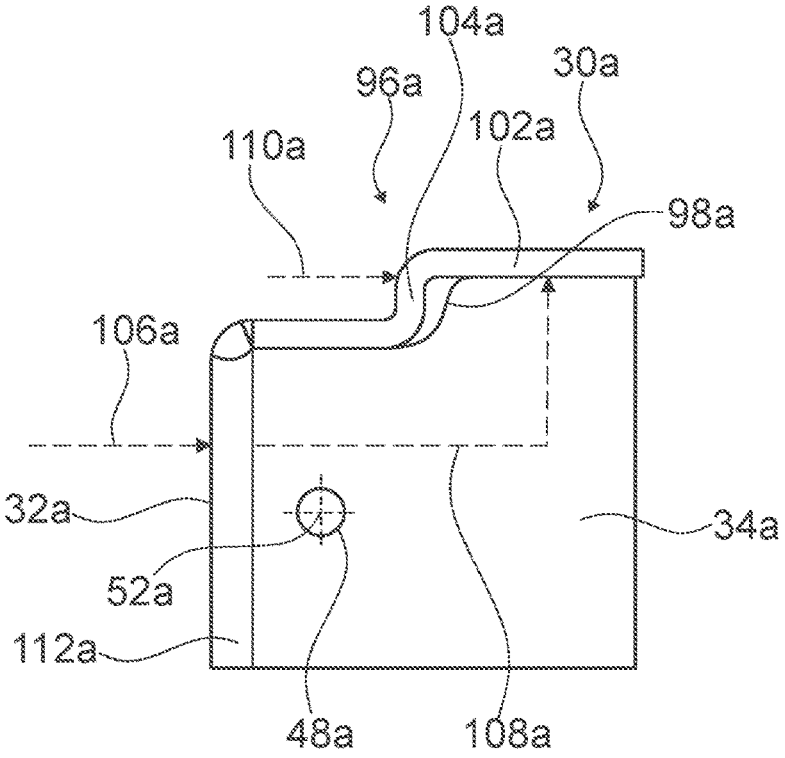
Figure 8:
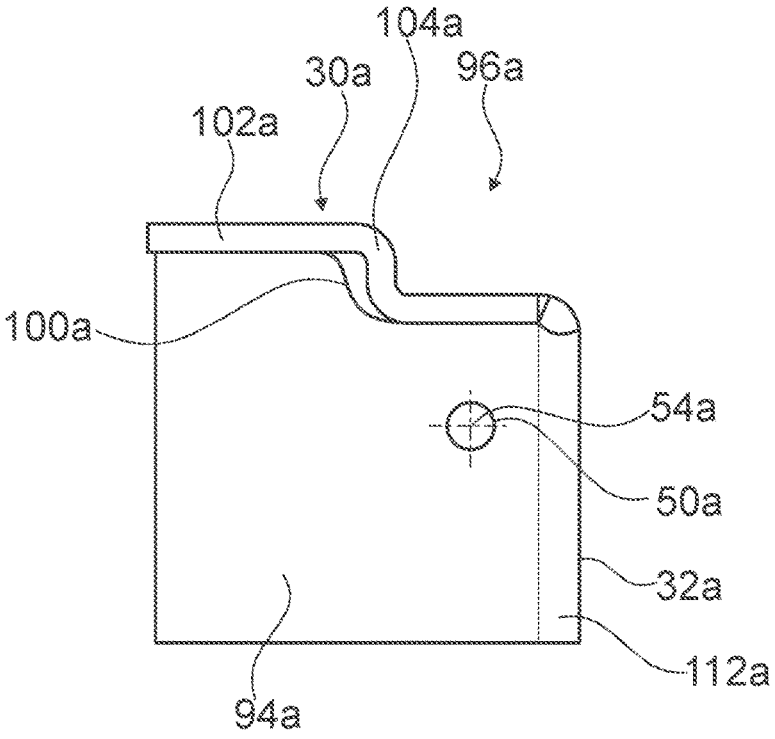
Figure 9:
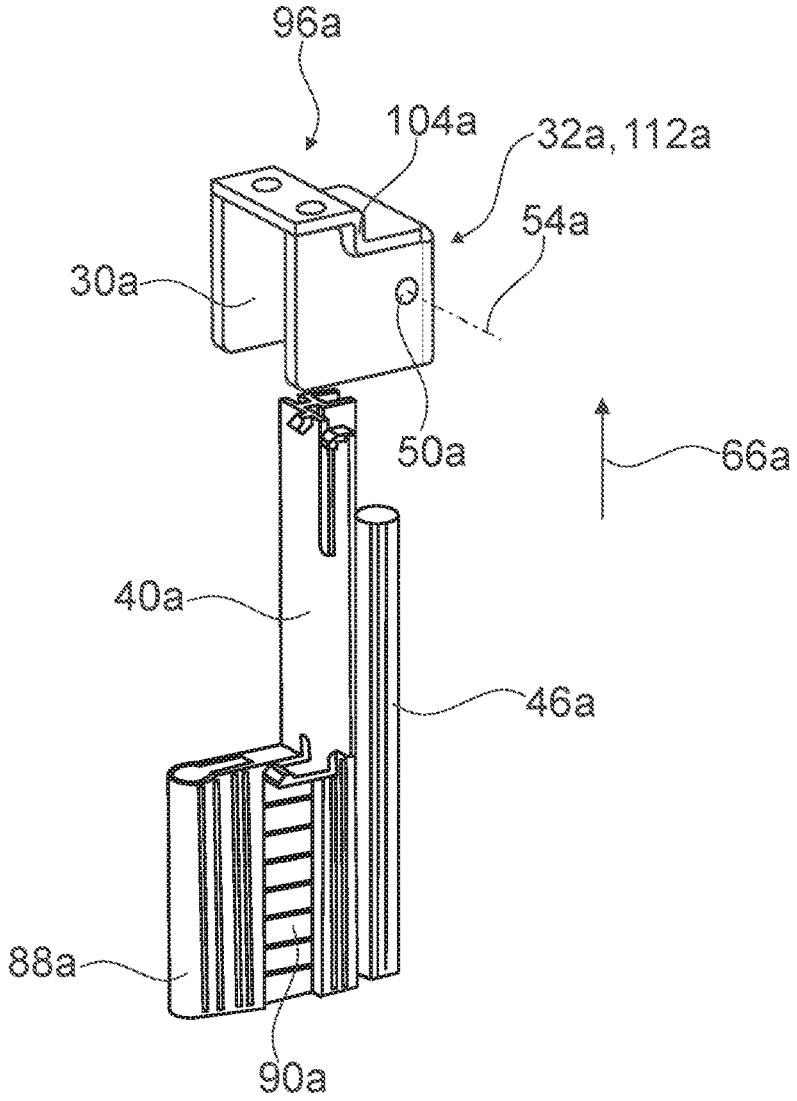

The contact element 30*a* and the air separator 40*a* are further shown in FIGS. 6 to 9. FIG. 6 shows the contact element 30*a*, in a perspective view. FIG. 7 shows the contact element 30*a*, in a schematic lateral view from a first lateral side. FIG. 8 shows the contact element 30*a* in an additional schematic lateral view from a second lateral side that is opposite the first lateral side. FIG. 9 shows the protrusion unit 22*a*, in a schematic exploded view.

The contact element 30*a* is implemented as a bent sheet metal piece. The contact element 30*a* has a closed-corner design. The contact element 30*a* features a contact element side wall 34*a* with a step-shaped contour 98*a*. The contact element side wall 34*a* is a lateral side wall. The step-shaped contour 98*a* is arranged on a top side 96*a* of the contact element 30*a*. The contact element 30*a* features a second contact element side wall 94*a* with a step-shaped contour 100*a*. The second contact element side wall 94*a* is a lateral side wall. The contact element 30*a* features a contact element top wall 102*a* which follows the step-shaped contour 98*a*. The contact element top wall 102*a* forms a step 104*a*. The contact element 30*a* is step-shaped. The contact element 30*a* is configured for transmitting a force 106*a* exerted onto the contact surface 32*a* along at least two different force transmission paths 108*a*, 110*a*.

The contact element top wall 102*a* is connected to the door 16*a*. In the case shown the contact element 30*a* is connected to the door 16*a* via screws.

The contact element 30*a* comprises a contact element front wall 112*a* which comprises the contact surface 32*a*. The contact element side wall 34*a*, the second contact element side wall 94*a* and the contact element top wall 102*a* are connected to the contact element front wall 112*a*. The contact element 30*a* is made of one piece.

The contact element 30*a* features two mounting holes 48*a*, 50*a* for the air separator 40*a* which have different hole axes 52*a*, 54*a*. The air separator 40*a* is connected to the contact element 30*a* via screws that are not shown in the figures and are arranged in the mounting holes 48*a*, 50*a*.

Figure 10:
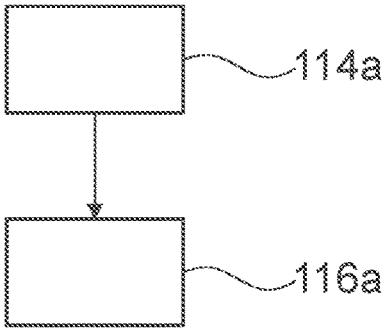

FIG. 10 shows a schematic flow chart of a method for assembling the home appliance device 10*a*. In a first assembly step 114*a* the contact element 30*a* is attached to the door 16*a*. In a second assembly step 116*a* the air separator 40*a* is attached to the contact element 30*a*. In the second assembly step 116*a* the air separator 40*a* is slid into the contact element 30*a* from below. Subsequently, the air separator 40*a* is fixed to the contact element 30*a* by means of screws which are screwed through the mounting holes 48*a*, 50*a* into the air separator 40*a*.

FIGS. 11 to 19 show further exemplary embodiments of the invention. The following description is substantially limited to the differences between the exemplary embodiments, wherein regarding structural elements, features and functions that remain the same the description of the other exemplary embodiments, in particular the exemplary embodiment of FIGS. 1 to 10, may be referred to. For distinguishing the exemplary embodiments, the letter a of the reference numerals in the exemplary embodiment of FIGS. 1 to 10 has been substituted by the letters b and c in the reference numerals of the exemplary embodiments of FIGS. 11 to 19. Regarding structural elements having the same denomination, in particular regarding structural elements having the same reference numerals, principally the drawing and/or the description of the other exemplary embodiments, in particular of the exemplary embodiment of FIGS. 1 to 10, may be referred to.

Figure 11:
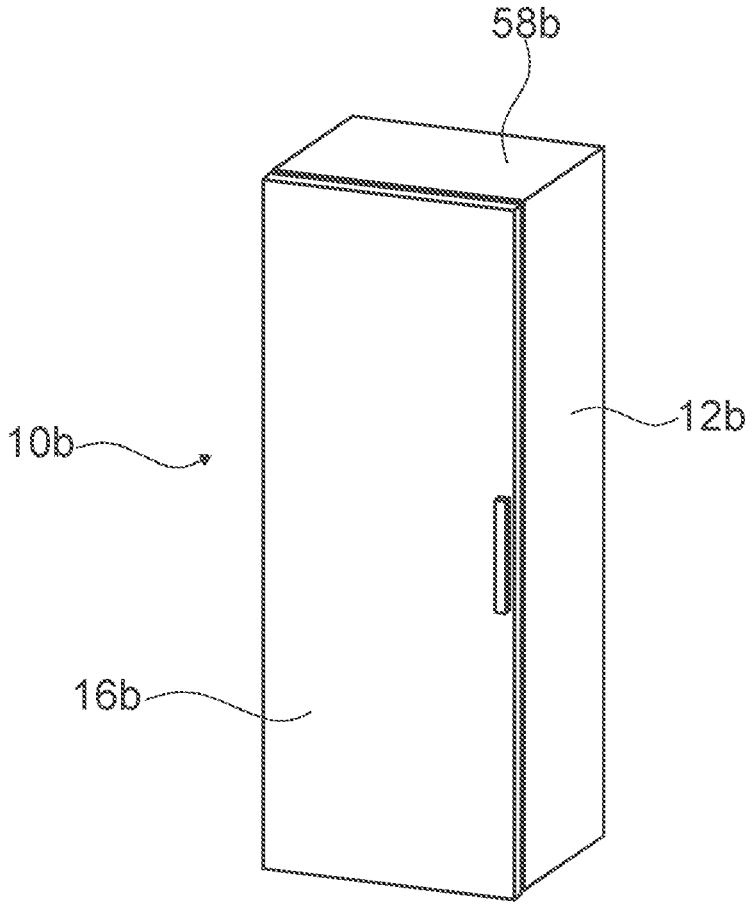

FIG. 11 shows an alternative home appliance 58*b* comprising an alternative home appliance device 10*b*, in a perspective view. The home appliance device 10*b* comprises a main body 12*b* and a door 16*b* which is mounted to the main body 12*b*.

Figure 12:
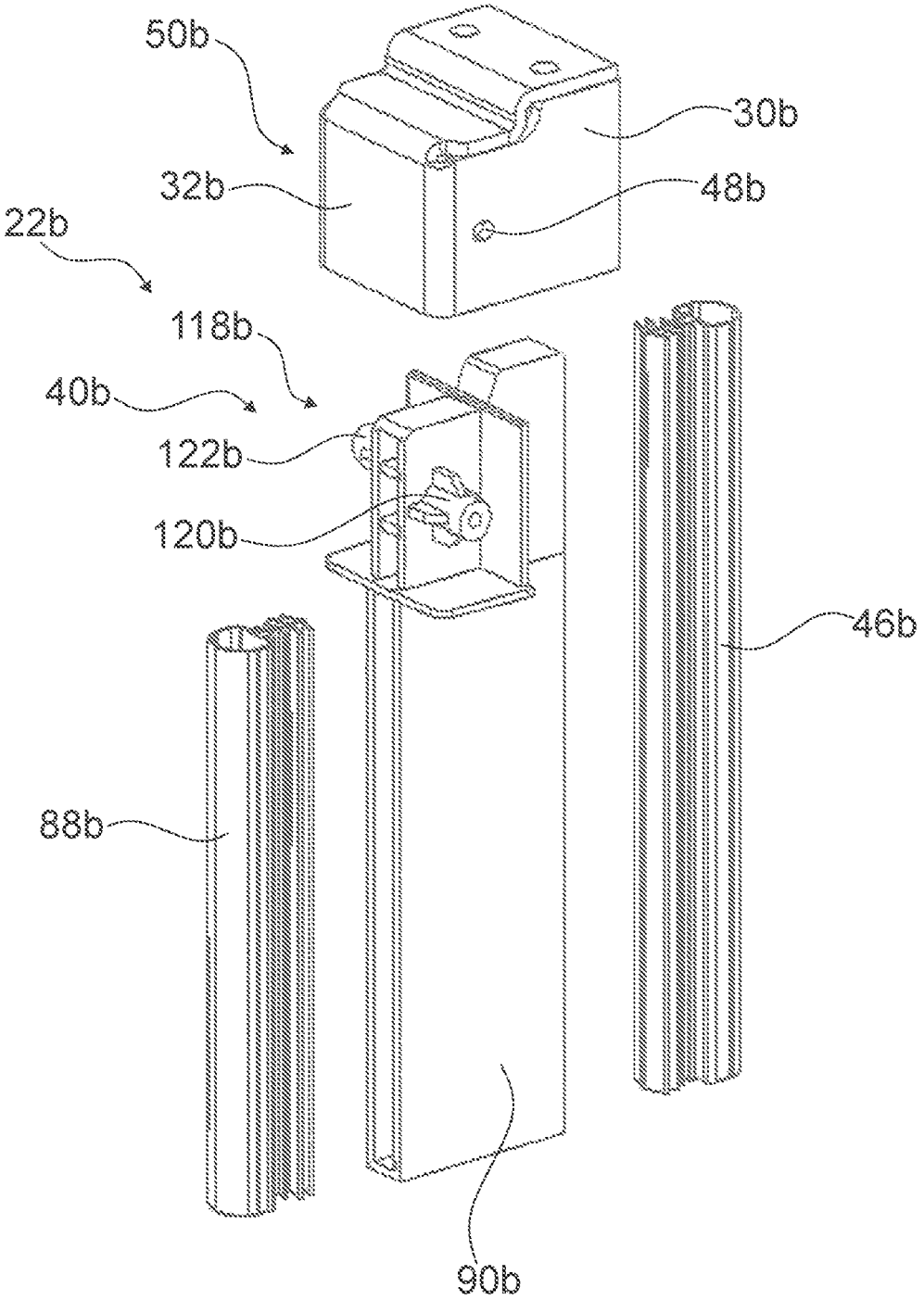

FIG. 12 shows a protrusion unit 22*b* of the alternative home appliance device 10*b*, in a schematic exploded view. The protrusion unit 22*b* is implemented analogously to the protrusion unit 22*a* of the exemplary embodiment of FIGS. 1 to 10.

The protrusion unit 22*b* comprises a contact element 30*b* and an air separator 40*b*. The air separator 40*b* comprises a support element 90*b*, a sealing element 46*b* and an additional sealing element 88*b*. In an assembled state the sealing element 46*b* contacts the main body 12*b*. The additional sealing element 88*b* is shorter than the sealing element 46*b* by approximately 25%.

The contact element 30*b* comprises a contact surface 32*b* for an opening element of a door opening assisting unit of the alternative home appliance device. The contact element 30*b* is implemented as a bent sheet metal piece. In the assembled state the air separator 40*b* is partly inserted in the contact element 30*b*.

Figure 13:
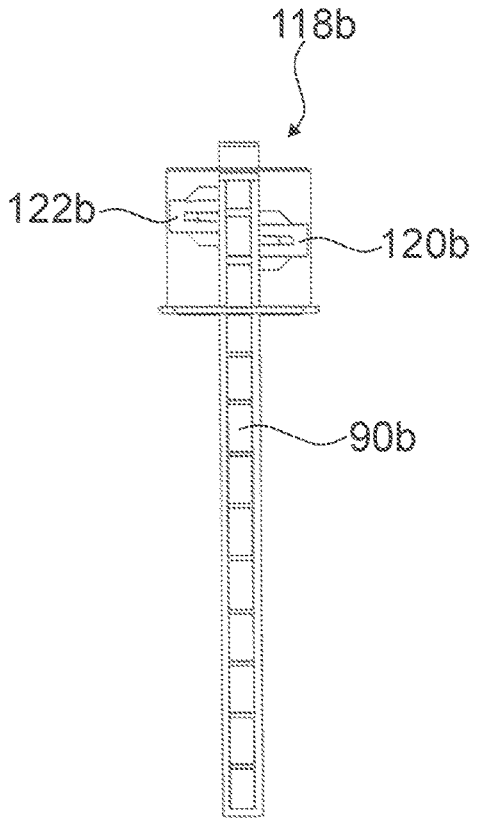
Figure 14:
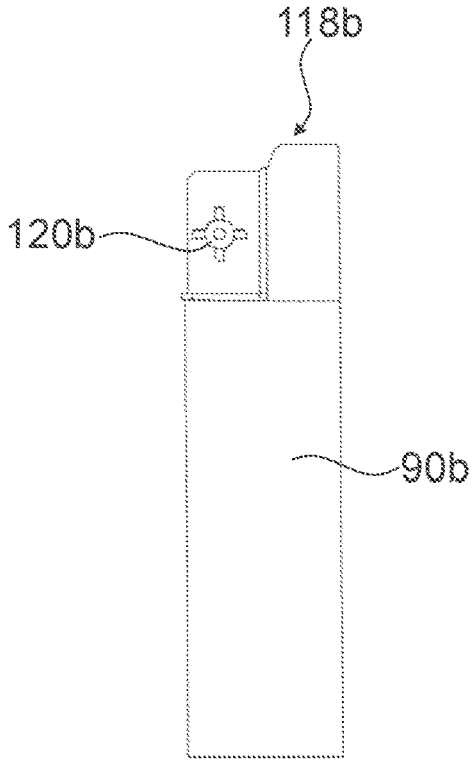

FIG. 13 shows the support element 90*b* of the air separator 40*b*, in a schematic front view. FIG. 14 shows the support element 90*b*, in a schematic lateral view. The support element 90*b* features a head portion 118*b*. In an assembled state, the head portion 118*b* is arranged within the contact element 30*b*. The head portion 118*b* features receiving elements 120*b*, 122*b* for fastening elements. The contact element 30*b* features mounting holes 48*b*, 50*b* for the air separator 40*b*. The air separator 40*b* is connected to the contact element 30*b* by means of fastening elements which are arranged in the mounting holes 48*b*, 50*b* and are connected to the receiving elements 120*b*, 122*b*. The receiving elements 120*b*, 122*b* are arranged in a staggered manner.

Figure 15:
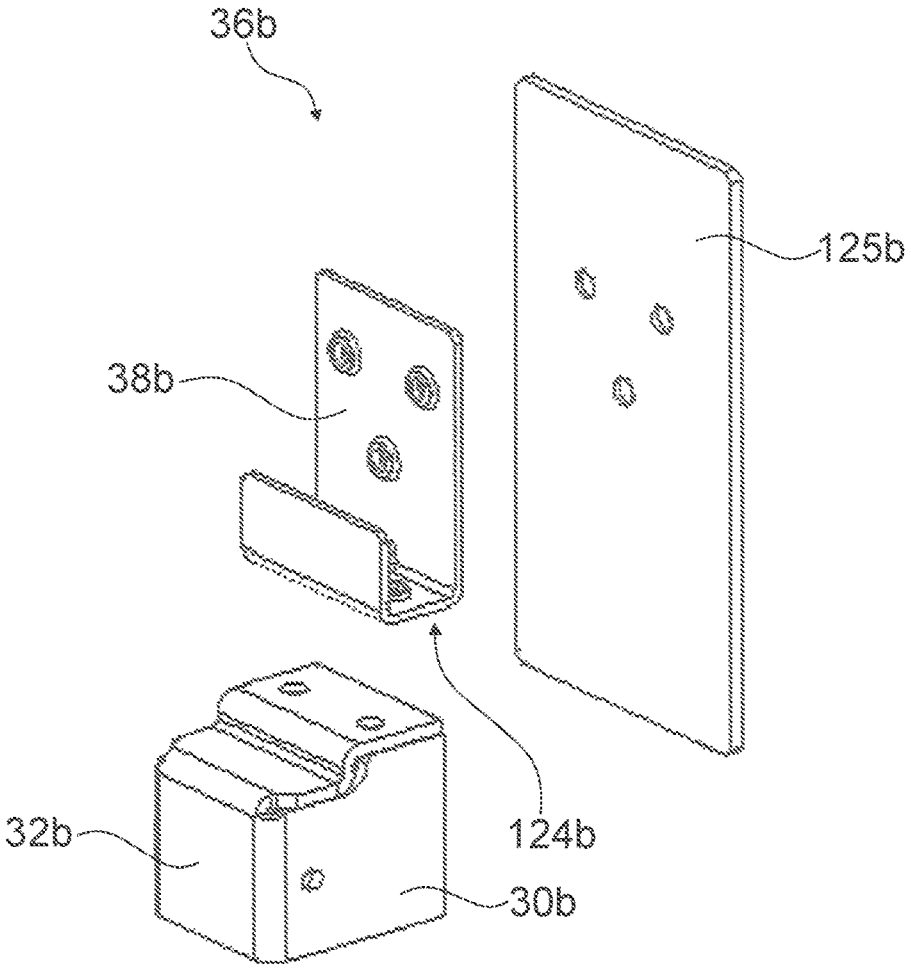

FIG. 15 shows the contact element 30*b* and a fixing unit 36*b* of the alternative home appliance device 10*b*, in a perspective view. The fixing unit 36*b* comprises a fixing element 38*b*. In the assembled state the contact element 30*b* is fixed to the fixing element 38*b*. Furthermore, in the assembled state the fixing element 38*b* is arranged inside a foamed gap space of the door 16*b*. The contact element 30*b* is screwed to the fixing element 38*b* from a bottom side 124*b* of the fixing element 38*b*. The fixing element 38*b* is made of metal.

In the case shown the fixing unit 36*b* comprises a support element 125*b* which the fixing element 38*b* is connected to. The fixing element 38*b* is screwed to the support element 125*b*. The support element 125*b* is a metal plate. The support element 125*b* is arranged outside the foamed gap space of the door 16*b*. The support element 125*b* is arranged within the door 16*b*. The support element 125*b* is arranged on a side of the foamed gap space of the door 16*b* which faces away from the main body 12*b*.

Figure 16:
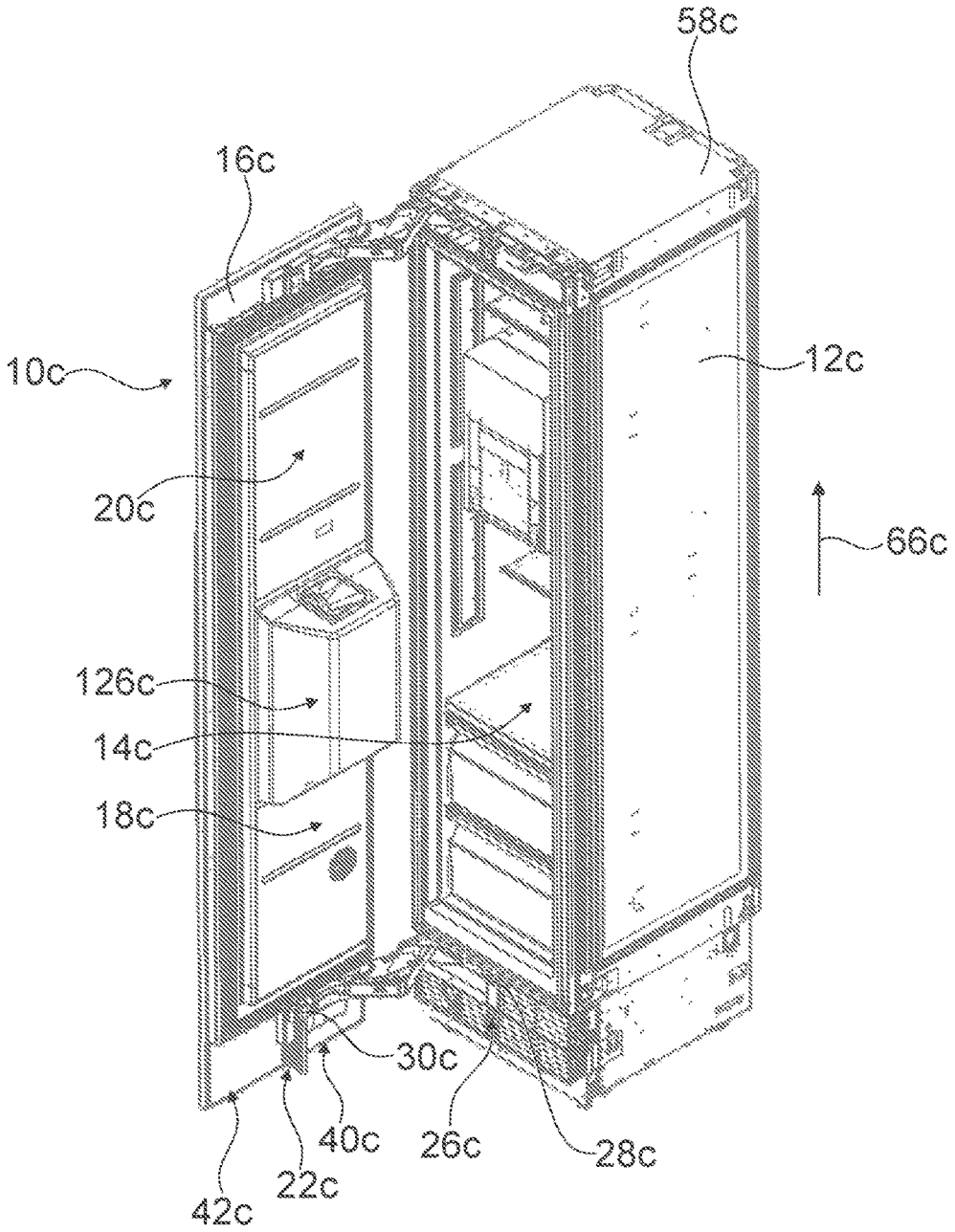
Figure 17:
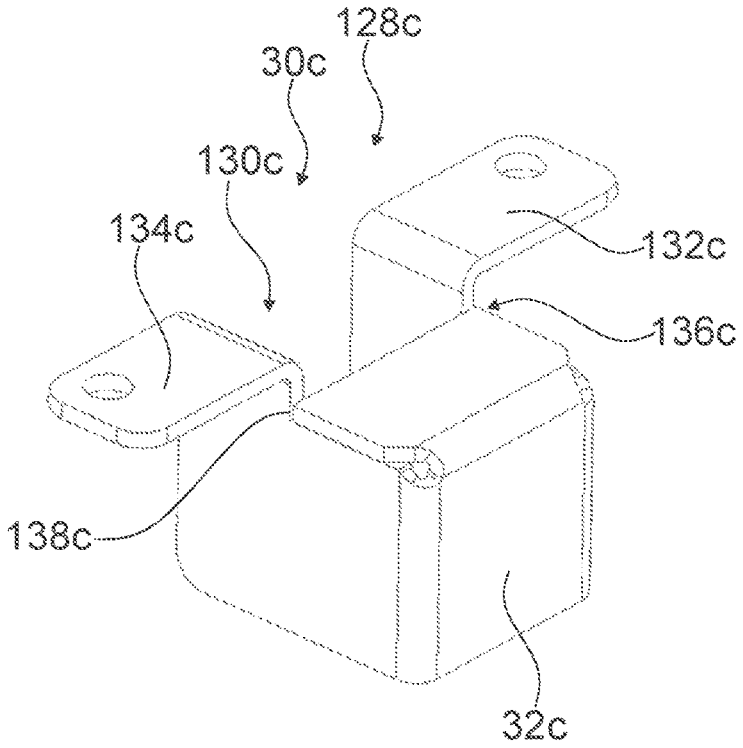

FIG. 16 shows a further alternative home appliance 58*c*, in a perspective view. The further alternative home appliance 58*c* comprises a further alternative home appliance device 10*c*. The further alternative home appliance 58*c* is implemented as a refrigerator. The further alternative home appliance device 10*c* is implemented as a home chiller appliance device. The further alternative home appliance device 10*c* comprises a main body 12*c* that defines a storage space 14*c*. The further alternative home appliance device 10*c* comprises a door 16*c* mounted to the main body 12*c*, which door 16*c* features a sealed door section 18*c* that forms a portion of a front wall 20*c*, in particular the entire front wall 20*c*, of the storage space 14*c*. The further alternative home appliance device 10*c* comprises a protrusion unit 22*c* which is arranged next to the sealed door section 18*c* outside the storage space 14*c* and protrudes from the door 16*c* towards the main body 12*c*.

The protrusion unit 22*c* features a smaller horizontal extent 24*c* than the sealed door section 18*c*.

The further alternative home appliance device 10*c* comprises a door opening assisting unit 26*c* which has an opening element 28*c*. The protrusion unit 22*c* features a contact element 30*c* for the opening element 28*c*. The contact element 30*c* is shown in two different perspective views in FIGS. 17 and 18. The contact element 30*c* features a contact surface 32*c* for the opening element 28*c*, which contact surface 32*c* is aligned parallel to a main extension plane of the door 16*c*.

The protrusion unit 22*c* features an air separator 40*c* which separates two adjacent air spaces 42*c*, 44*c* located outside the storage space 14*c* and arranged between the door 16*c* and the main body 12*c*.

The home appliance device 10*c* comprises an ice water dispenser unit 126*c*. The ice water dispenser unit 126*c* is connected to the door 16*c*. The ice water dispenser unit 126*c* is arranged inside the storage space 14*c* in a closed state of the door 16*c*. It is also conceivable that an ice water dispenser unit is arranged outside a storage space.

Figure 18:
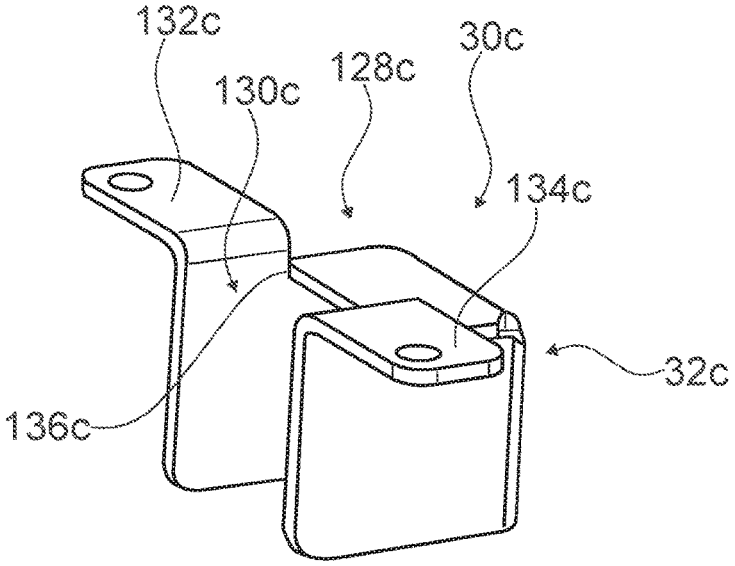
Figure 19:
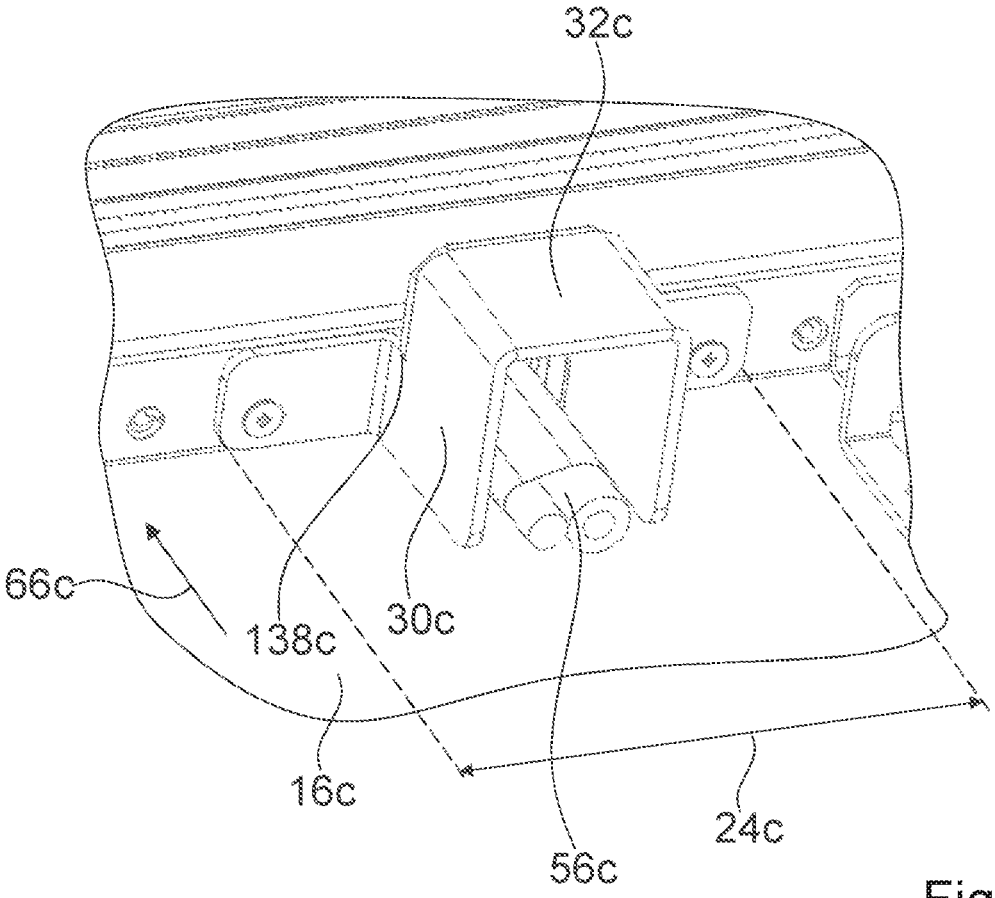

FIG. 18 shows a portion of the further alternative home appliance device 10*c*, in a perspective view. The ice water dispenser unit 126*c* comprises a liquid line 5*c*. The liquid line 56*c* is a water supply line. The liquid line 56*c* runs through the protrusion unit 22*c*. The liquid line 56*c* runs through the contact element 30*c*. The liquid line 56*c* runs through the protrusion unit 22*c* in a direction parallel to a height direction 66*c* of the main body 12*c*. The contact element 30*c* is open towards a top side 128*c* of the contact element 30*c* in order to provide an opening 130*c* for the liquid line 56*c*. The contact element 30*c* comprises a connection element 132*c* for fixing to the door 16*c*. The connection element 132*c* is wing-shaped. The connection element 132*c* is bent outward with respect to the opening 130*c*. The contact element 30*c* comprises an additional connection element 134*c* for fixing to the door 16*c*. The additional connection element 134*c* is implemented mirror-symmetrically with respect to the connection element 132*c*. The connection element 132*c* and the additional connection element 134*c* are screwed to the door 16*c*. The connection element 132*c* implements a force transmission point 136*c* towards a contact element top wall 102*c* and a contact element front wall 112*c*, which contact element front wall 112*c* features the contact surface 32*c*. An opening force is transmitted from the contact surface 32*c*, via the force transmission point 136*c*, towards the connection element 132*c* and to the door 16*c*. Analogously, the additional connection element 134*c* implements an additional force transmission point 138*c*.

The following is a summary list of reference numerals and the corresponding structure used in the above description of the invention:

10 home appliance device
12 main body
14 storage space
16 door
18 sealed door section
20 front wall
22 protrusion unit
24 horizontal extent
26 door opening assisting unit
28 opening element
30 contact element
32 contact surface
34 contact element side wall
36 fixing unit
38 fixing element
40 air separator
42 air space
44 air space
46 sealing element
48 mounting hole
50 mounting hole
52 hole axis
54 hole axis
56 liquid line
58 home appliance
60 sealing lip
62 outer liner
64 inner liner
66 height direction
68 non-sealed door section
70 horizontal extent
72 horizontal direction
74 machine compartment
76 sub-compartment
78 sub-compartment
80 wall
82 ventilation grille
84 fresh-air entrance
86 heated-air exit
88 sealing element
90 support element
92 cover element
94 contact element side wall
96 top side
98 contour
100 contour
102 contact element top wall
104 step
106 force
108 path
110 path
112 contact element front wall
114 assembly step
116 assembly step
118 head portion
120 receiving element
122 receiving element
124 bottom side
125 support element
126 ice water dispenser unit
128 top side
130 opening
132 connection element
134 connection element
136 force transmission point
138 force transmission point

The invention claimed is:

1. A home appliance device comprising:

at least one main body defining at least one storage space;

at least one door mounted to the main body, said at least one door having an inside face, an outside face, and an outer perimeter bounding said inside face and said outside face;

said at least one door featuring at least one sealed door section, on the inside face, that forms at least a portion of a front wall of the storage space in a closed position of said at least one door;

at least one protrusion unit arranged next to the sealed door section, within the outer perimeter and on the inside face of said at least one door, outside the storage space and protruding from the inside face of the at least one door towards the main body, said at least one protrusion unit comprising a contact element having a contact surface and an air separator adjoining the contact surface and extending substantially vertically and between the at least one door and the main body to form two separate air spaces outside the storage space and between the door and the main body; and a door opening assisting unit mounted in said main body, said door opening assisting unit having a door opening element configured to push against said contact surface on said at least one protrusion unit in order to assist in opening said at least one door.

2. The home appliance device according to claim 1, the protrusion unit featuring a smaller horizontal extent than the sealed door section.

3. The home appliance device according to claim 1, wherein the contact surface is aligned at least substantially parallel to a main extension plane of the door.

4. The home appliance device according to claim 1, the contact element being implemented as a bent sheet metal piece.

5. The home appliance device according to claim 1, the contact element featuring at least one contact element side wall with a step-shaped contour.

6. The home appliance device according to claim 1, comprising a fixing unit featuring at least one fixing element, the contact element being fixed to the fixing element, and the fixing element being arranged inside a foamed gap space of the door.

7. The home appliance device according to claim 1, the air separator featuring at least one sealing element that contacts the main body.

8. The home appliance device according to claim 1, the air separator being connected to the contact element.

9. The home appliance device according to claim 8, the air separator being partly inserted in the contact element.

10. The home appliance device according to claim 8, the contact element featuring at least two mounting holes for the air separator which have different hole axes.

11. The home appliance device according to claim 1, comprising at least one liquid line which runs through the protrusion unit.

12. A home appliance, in particular a home chiller appliance, comprising at least one home appliance device according to claim 1.

13. The home appliance device according to claim 1, wherein said at least one protrusion unit is disposed substantially centrally between a right-hand edge and a left-hand edge of said at least one door, and adjacent a lowermost edge of said at least one door.

14. The home appliance device according to claim 1, wherein said opening element is a push rod.

15. A method for assembling a home appliance device, in particular a home chiller appliance device, comprising:

at least one main body defining at least one storage space;

at least one door mounted to the main body and featuring at least one sealed door section that forms at least a part of a front wall of the storage space;

at least one door opening assisting unit having at least one opening element; and at least one protrusion unit arranged next to the sealed door section outside the storage space, which protrudes from the door towards the main body and which features at least one contact element for the opening element and at least one air separator adjoining the contact element and extending substantially vertically and between the at least one door and the main body thereby separating two adjacent air spaces located outside the storage space and arranged between the door and the main body; wherein the air separator is attached to the contact element.

16. The method according to claim 15 configured for assembling a home chiller appliance device according to claim 1.

* * * * *